US010422207B2

(12) United States Patent
Aidagulov et al.

(10) Patent No.: US 10,422,207 B2
(45) Date of Patent: Sep. 24, 2019

(54) METHODS FOR CREATING MULTIPLE HYDRAULIC FRACTURES IN OIL AND GAS WELLS

(71) Applicant: Schlumberger Technology Corporation, Sugar Land, TX (US)

(72) Inventors: Gallyam Aidagulov, Dammam (SA); Dominic Joseph Brady, Al-Khobar (SA); Eric Edelman, Salt Lake City, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 190 days.

(21) Appl. No.: 15/451,269

(22) Filed: Mar. 6, 2017

(65) Prior Publication Data

US 2017/0254186 A1 Sep. 7, 2017

Related U.S. Application Data

(60) Provisional application No. 62/304,591, filed on Mar. 7, 2016.

(51) Int. Cl.

| | |
|---|---|
| ***E21B 43/26*** | (2006.01) |
| ***E21B 47/00*** | (2012.01) |
| ***E21B 43/25*** | (2006.01) |
| ***E21B 43/30*** | (2006.01) |
| ***E21B 43/00*** | (2006.01) |
| ***E21B 7/04*** | (2006.01) |

(Continued)

(52) U.S. Cl.

CPC ..... *E21B 43/26* (2013.01); *E21B 7/04* (2013.01); *E21B 43/00* (2013.01); *E21B 43/25* (2013.01); *E21B 43/255* (2013.01); *E21B 43/267* (2013.01); *E21B 43/305* (2013.01); *E21B 47/00* (2013.01); *E21B 49/006* (2013.01)

(58) Field of Classification Search

CPC ..... E21B 43/26; E21B 43/267; E21B 43/255; E21B 43/25; E21B 43/305; E21B 7/04; E21B 43/00; E21B 49/006; E21B 47/00

See application file for complete search history.

(56) References Cited

U.S. PATENT DOCUMENTS

| | | | | |
|---|---|---|---|---|
| 2,970,645 A | | 2/1961 | Glass et al. | |
| 4,718,490 A | * | 1/1988 | Uhri | E21B 43/261 166/271 |
| 5,238,067 A | | 8/1993 | Jennings, Jr. | |

(Continued)

OTHER PUBLICATIONS

Aidagulov, G. et al., "Model of Hydraulic Fracture Initiation from the Notched Open Hole", SPE 178027-MS, presented at the SPE Saudi Arabia Section Annual Technical Symposium and Exhibition, Al-Khobar, Saudi Arabia, 2015, 13 pages.

(Continued)

*Primary Examiner* — Yong-Suk Ro

(57) ABSTRACT

Transverse fractures are formed from a borehole using hydraulic fracturing fluid while maintaining the downhole pressure close to a target pressure. The target pressure is selected to be greater than the expected transverse fracture initiation pressure at predetermined weak points, such as notches, and less than the expected longitudinal fracture initiation pressure. The process can be repeated to form multiple transverse fractures by pumping diversion composition(s).

17 Claims, 6 Drawing Sheets

(51) Int. Cl.
*E21B 49/00* (2006.01)
*E21B 43/267* (2006.01)

(56) References Cited

U.S. PATENT DOCUMENTS

| | | | | | |
|---|---|---|---|---|---|
| 5,579,842 | A * | 12/1996 | Riley | E21B 34/14 | 166/250.01 |
| 7,644,761 | B1 * | 1/2010 | Gu | E21B 43/267 | 166/280.1 |
| 7,828,063 | B2 * | 11/2010 | Olsen | E21B 49/006 | 166/177.5 |
| 2013/0118750 | A1 * | 5/2013 | Gu | E21B 43/26 | 166/308.1 |
| 2014/0069653 | A1 * | 3/2014 | Liu | E21B 49/006 | 166/308.1 |
| 2014/0096950 | A1 * | 4/2014 | Pyecroft | E21B 43/26 | 166/247 |
| 2014/0278316 | A1 * | 9/2014 | Dusterhoft | E21B 43/26 | 703/10 |
| 2016/0153239 | A1 * | 6/2016 | Randall | E21B 7/061 | 175/4.57 |

OTHER PUBLICATIONS

Detournay, E. et al., "Fracture-Mechanics Analysis of the Breakdown Process in Minifracture or Leakoff Test", SPE 28076-PA, SPE Production & Facilities, 1997, 12(3), pp. 195-199.

LeCampion, B. et al., "Competition between transverse and axial hydraulic fractures in horizontal wells", SPE 163848-MS, presented at the SPE Hydraulic Fracturing Technology Conference, The Woodlands, Texas, 2013, 13 pages.

LeCampion, B. et al., "Simultaneous Initiation of Multiple Transverse Hydraulic Fracturs from Horizontal Well", ARMA 14-7110, presented at the 48th U.S. Rock Mechanics/Geomechanics Symposium, Minneapolis, Minnesota, USA, 2014, 21 pages.

Lu, G. et al., "Experimental Demonstration of Delayed Initiation of Hydraulic Fractures below Breakdown Pressure in Granite", ARMA 15-190, presented at the 49th US Rock Mechanics/Geomechanics Symposium, San Francisco, Califomia, USA, 2015, pp.

Weijers, L. et al., "Geometry of Hydraulic Fractures Induced from Horizontal Wellbores", SPE 25049-PA, SPE Production & Facilities 1994, 9(2), pp. 87-92.

Daneshy, A. "Horizontal Well Fracturing: A State-of-the-Art Report", 2013, World Oil, 234(7), pp. S-147-S-151.

* cited by examiner

METHODS FOR CREATING MULTIPLE HYDRAULIC FRACTURES IN OIL AND GAS WELLS

CROSS REFERENCE TO RELATED APPLICATIONS

This application claims priority from U.S. Ser. No. 62/304,591, filed Mar. 7, 2016, the contents of which are incorporated herein by reference.

FIELD

The subject disclosure generally relates to the field of hydraulic fracturing. More specifically, this subject disclosure relates to methods for creating multiple hydraulic fractures in oil and gas wells.

BACKGROUND

Wellbore treatment methods often are used to increase hydrocarbon production by using a treatment fluid to affect a subterranean formation in a manner that increases oil or gas flow from the formation to the wellbore for removal to the surface. Major types of such treatments include fracturing operations, high-rate matrix treatments and acid fracturing, matrix acidizing and injection of chelating agents. Hydraulic fracturing involves injecting fluids into a subterranean formation at pressures sufficient to form fractures in the formation, with the fractures increasing flow from the formation to the wellbore. In chemical stimulation, flow capacity is improved by using chemicals to alter formation properties, such as increasing effective permeability by dissolving materials in or etching the subterranean formation. A wellbore may be an open hole or a cased hole where a metal pipe (casing) is placed into the drilled hole and is often cemented in place. In a cased wellbore, the casing (and cement if present) typically is perforated in specified locations to allow hydrocarbon flow into the wellbore or to permit treatment fluids to flow from the wellbore to the formation.

To access hydrocarbon effectively and efficiently, it may be desirable to direct the treatment fluid to multiple target zones of interest in a subterranean formation. There may be target zones of interest within various subterranean formations or multiple layers within a particular formation that are preferred for treatment. In previous methods of hydraulic fracturing treatments, multiple target zones were typically treated by treating one zone within the well at a time. These methods usually involved multiple steps of running a perforating gun down the wellbore to the target zone, perforating the target zone, removing the perforating gun, treating the target zone with a hydraulic fracturing fluid, and then isolating the perforated target zone. This process is then subsequently repeated for all the target zones of interest until all the target zones are treated. As can be appreciated, such methods of treating multiple zones can be highly involved, time consuming and costly.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a method is disclosed for creating multiple traverse hydraulic fractures in an earth formation surrounding a wellbore formed in the earth formation. The method includes: injecting fracturing fluid into a borehole at a constant rate until a pressure reaches a target pressure level; and maintaining the pressure at the target pressure level by adjusting an injection rate of the fracturing fluid until a fracture initiates; wherein a target pressure level is chosen to be above an initiation pressure for a transverse fracture but below the initiation pressure for a longitudinal fracture.

According to some embodiments, a method is described for creating transverse hydraulic fractures in an earth formation surrounding a wellbore. The method includes: selecting a target downhole pressure level that is greater than an initiation pressure for a transverse fracture in the earth formation and less than an initiation pressure for a longitudinal fracture in the earth formation; injecting a fracturing fluid into the borehole; monitoring at least one parameter that can be related to downhole pressure; and controlling the fluid injection based on the monitored parameter in order to maintain a downhole pressure that is within a predetermined range of the selected target downhole pressure, thereby facilitating initiation of one or more transverse fractures without initiation of longitudinal fractures.

According to some embodiments, the method also includes forming one or more weak points along the wellbore that are configured to facilitate initiation of the one or more transverse fractures therefrom. In cases where the wellbore is open hole, the weak points can be perforations or notches formed using a technique such as: mechanical scribing, high pressure jetting, cutting with laser tools, or arranging of shaped charges. In cases where the wellbore is cased, the weak points can be in the form of one or more perforations in the casing.

According to some embodiments, the monitored parameter is pressure measured by a downhole pressure sensor. In some other cases, such as when a downhole pressure sensor is unavailable, the monitored parameter can be a surface measurement indicative of downhole pressure.

According to some embodiments, multiple transverse fractures are sequentially initiated such as by injecting a composition configured to temporarily plug one or more fractures (e.g. diverter pill) such that further transverse fractures may be initiated. According to some embodiments, in a first phase the fracturing fluid is injected into the wellbore at a constant flow rate. After the downhole pressure is within the predetermined range of the target downhole pressure, in a second phase, the fracturing fluid is injected into the wellbore so as to maintain the downhole pressure within the predetermined range of the target downhole pressure. Note that the transverse fractures can be initiated during the first and/or second phases.

According to some embodiments, the wellbore is horizontal or nearly horizontal and is formed along a minimal horizontal far-field stress of the earth formation.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

Figure 1A:
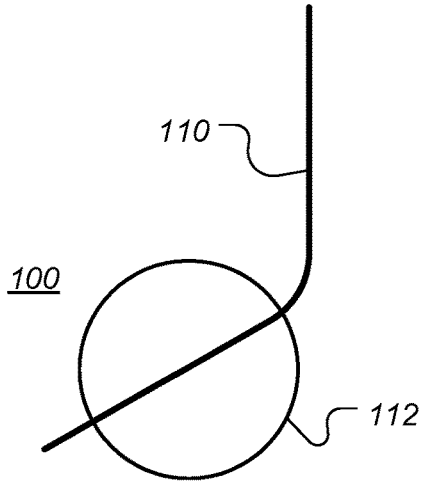
FIGS. 1A and 1B are schematic diagrams illustrating a single longitudinal fracture and multiple transverse fractures initiating from a horizontal wellbore.
Figure 1B:
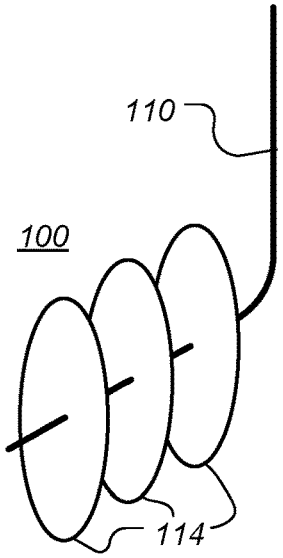

In low-permeability formations, operators often perform multistage hydraulic fracturing stimulation treatments on intervals along horizontal wells to produce commercial volumes of hydrocarbons. This practice usually aims to generate several hydraulic fractures transversely to the wellbore. FIGS. 1A and 1B are schematic diagrams illustrating a single longitudinal fracture and multiple transverse fractures initiating from a horizontal wellbore. In FIG. 1A, a single fracture 112 is oriented in-line, or longitudinally, with a horizontal (or nearly horizontal) portion of wellbore 110 which traverses reservoir rock formation 100. In FIG. 1B, multiple fractures 114 are formed in a transverse orientation with respect to the horizontal portion of wellbore 110. Providing multiple transverse fractures, such as shown in FIG. 1B provides greater reservoir contact area compared to a single longitudinal fracture as shown in FIG. 1A. To ensure transverse orientation of the fractures, on a larger scale the stimulated section of the wellbore should be oriented along the minimal horizontal far-field stress, which will be assumed hereafter in embodiments of the present disclosure.

However, due to local stress concentration effects in the vicinity of the wellbore, orienting the wellbore in the direction of the minimal stress will not generally guarantee initiation of the fracture(s) in the transverse direction. In many cases the hoop stress around the wellbore is the maximum tensile stress during the wellbore pressurization phase and it reaches the critical rock strength value before that required for a transverse fracture. In such cases, the hydraulic fracture initiates longitudinally. As the fracture grows it will reorient into the transverse direction as dictated by the far-field stresses. See e.g., Weijers, L., de Pater, C. J., Owens, K. A. et al. 1994. Geometry of Hydraulic Fractures Induced from Horizontal Wellbores, SPE Prod & Fac 9 (2): 87-92. SPE-25049-PA and Daneshy, A. 2013. Horizontal Well Fracturing: A State-of-the-Art Report. World Oil 234 (7). While the uncontrolled axial extent of longitudinally initiated fractures poses a risk of breaching the isolation between fracturing stages, their reorientations may result in near-wellbore fracture tortuosity leading to increased treatment pressures, proppant screen-outs and reduced completion quality. In addition, the fracture may reorient outside of key hydrocarbon target layers, with the potential to considerably reduce productivity. Consequently, ensuring initiation and early-stage growth of each hydraulic fracture in the transverse direction is desirable in multistage stimulation treatments.

Traditionally, in either cemented-and-cased or openhole horizontal wells, the stimulated interval is separated into hydraulically isolated stages with fractures created subsequently by fluid injection into a single stage at a time. In practice, the number of fracturing stages run in one well is limited by either cost or equipment capabilities. Hence, the total number of hydraulic fractures can be maximized by techniques enabling multiple fractures to be initiated and grown from several locations within the stimulated stage. Equally this approach could be used to make marginal plays more economical by a reduction in the cost and complexity of generating a small number of fractures, in both new and brownfield wells. According to some embodiments of the present disclosure, a specific workflow to initiate and grow multiple transverse hydraulic fractures is described. The conditions for placement and orientation of the fractures will be distinguished for the cemented-and-cased and openhole completions.

In cemented-and-cased wells, fracturing fluid can enter the rock only through perforation clusters to initiate hydraulic fractures from those locations along the wellbore. Significant friction exerted at perforations allows distribution of fracturing fluid between fractures initiated at different clusters but within the same stage, and their further growth as injection continues. This approach to multiple fracture initiation is known as the limited entry technique. See Lecampion, B. and Desroches, J. 2014. Simultaneous Initiation of Multiple Transverse Hydraulic Fractures from Horizontal Well. Presented at the 48th US Rock Mechanics/Geomechanics Symposium, 1-4 June, Minneapolis, Minn., USA. ARMA 14-7110). In addition, the casing shelters the near wellbore zone from the wellbore pressure and the injection even at a very high rate will not promote an increase of the hoop stress component to the level sufficient to initiate a longitudinal fracture, on the assumption that the cement is continuous and of high quality.

Figure 2:
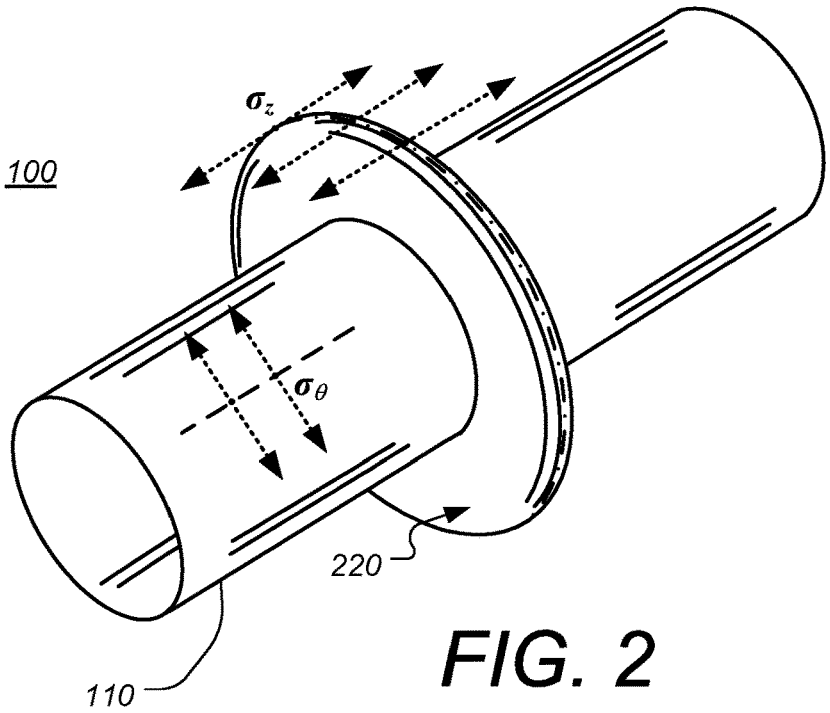
FIG. 2 is a diagram illustrating a circular notch created from a wellbore for purposes of initiating a fracture in the surrounding rock formation.

In openhole wellbores, the position of initiated fractures cannot be controlled until it is defined by the weak point placed in the wellbore wall. In the absence of a weak point the fracture will initiate at the most mechanically advantageous point as determined by factors such as borehole rugosity, mineral strength (layering or laminations), fluid leak off, and local stress concentrators from vugs or breakouts. Clearly this lack of control represents a significant risk to fracturing petrophysically poor regions. The weak point can be created in the form of 360° perforations (hereafter referred to as circular notch) or several in-plane perforation tunnels. See co-owned, US Patent Appl. Publ. No.: 2014/0069653, entitled "Method for Transverse Fracturing of a Subterranean Formation", the contents of which are herein incorporated by reference. FIG. 2 is a diagram illustrating a circular notch created from a wellbore for purposes of initiating a fracture in the surrounding rock formation. The circular notch (360° perforation) 220 is cut transversely to the wellbore 110 or slightly inclined—to make it orthogonal to the minimum far-field stress direction at a specific petrophysically interesting location, allowing compensation for imperfect drilling. The hoop stress ($\sigma_\theta$) and axial stress ($\sigma_Z$) components are shown at the surface of the wellbore 110 and notch 220 respectively. The hoop stress component $\sigma_\theta$ will tend to open a longitudinal fracture (dashed line) whereas the axial stress component $\sigma_Z$ tends to open a transverse fracture along the dash-dotted line at the tip of the notch 220. In this case, the tensile axial stress $\sigma_Z$ concentration developed at the notch tip allows a transverse fracture to initiate in formation 100 at a wellbore pressure lower than it would be required to initiate it at any other un-notched location. See, Aidagulov, G., Alekseenko, O., Chang, F. F., et al. 2015. Model of Hydraulic Fracture Initiation from the Notched Open Hole. Presented at the SPE Saudi Arabia Section Annual Technical Symposium and Exhibition, Al-Khobar, Saudi Arabia, 21-23 April. SPE-178027-MS. This includes locations along a stimulated stage, which are subjected to lower stress, surrounded by weaker rock or "pre-stretched" in hoop direction by the packer.

Figure 3:
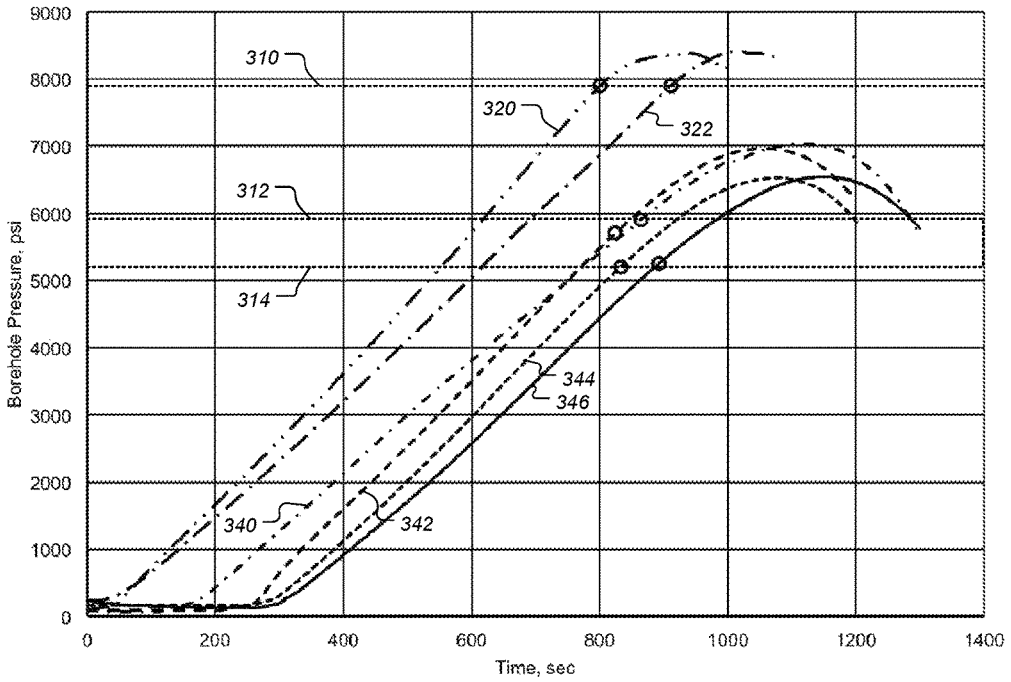
FIG. 3 is a plot illustrating laboratory results of hydraulic fracture initiation according to some embodiments.

Notching such as shown in FIG. 2 as a way to control the position and orientation of initiated fractures and lowering fracture initiation/breakdown pressure from the open hole has been demonstrated by numerous laboratory tests. FIG. 3 is a plot illustrating laboratory results of hydraulic fracture initiation, according to some embodiments. The lab test, a rock sample was cut in the shape of a rectangular block with a borehole formed in its center. The block was loaded into a true-triaxial stress frame. The minimal stress was applied in the direction of the borehole. The minimal stress applied was at 2,250 psi while the other stresses were at 3,000 psi and 3,500 psi. Only the upper part of the borehole was cemented and cased, while its larger part in the center of the block was left open. During the test, viscous fracturing fluid was injected into the borehole at a prescribed (fixed) rate. It was repeatedly shown that without a notch, hydraulic fractures always initiate longitudinally. When a circular notch of 1.2-1.5 wellbore diameters (WBD) deep was cut in the center of the open hole, then the fracture initiated at the notch in the transverse direction at pressures 2,000-2,700 psi, or roughly 25% lower. According to some embodiments, in addition to controlling the location of the fracture, techniques were demonstrated that directly translate into a reduction in plant and fluid requirements used to generate fractures.

Curves 340 and 342 show the borehole pressure vs. time characteristics for notches cut to 1.2 WBD deep into the rock, while curves 344 and 346 are for notches having depth of 1.5 WBD. The circles indicate that point at which fractures were initiated. For test with single notches in the range of 1.2 and 1.5 wellbore diameters (WBD) in depth, the transverse hydraulic fractures initiated repeatedly at wellbore pressures within the range of 5,200 psi (dotted line 314) and 5,900 psi (dotted line 312). Curves 320 and 322 show the pressure vs. time characteristics for notch-free wellbores. In the absence of a notch the fracture was always longitudinal and occurred at about 7,900 psi (dotted line 310).

As can be seen in FIG. 3, the pressure within the wellbore continues to increase for some time after fracture initiation. The pressure reaches its maximum value—known as breakdown pressure—once the initiated fracture is able to take all the injected fluid. This will not happen immediately after fracture initiation, but rather after the fracture has grown to sufficient size. The difference between initiation and breakdown pressures may be quite significant and depends on the orientation of the initiated fracture as well as on fluid viscosity and injection rate. For the experimental data in FIG. 3, this difference was about 500 psi for longitudinal fractures and 1,300 psi for transverse fractures for all notch depths. Another observation from the test shown in FIG. 3 is that for all notch depths considered here, breakdown (and maximum) pressures for transverse fractures were less than initiation pressure for longitudinal fracture in the cases without notches, about 6,500-7,000 compared with 7,900 psi. Therefore, it is possible to ensure that only transversely orientated fractures are initiated by maintaining the bottom hole pressure during the injection to pressures below the initiation pressure for longitudinal fractures.

In the tests shown in FIG. 3, as in many other hydraulic fracturing tests in the lab, the viscosity of fracturing fluid was much larger than the one normally used in the field: 1,000-1,000,000 cP versus 10-500 cP. Thicker fracturing fluids are used in the lab to control leakoff and propagation of the fracture due to the limited size of the block sample. Despite the large difference in viscosities, there are indications that significant differences between initiation and breakdown pressures may also be expected for the field conditions. This has been demonstrated theoretically for both transverse and longitudinal fractures initiated at the open hole in Lecampion, B., Abbas, S. and Prioul, R. 2013, "Competition between transverse and axial hydraulic fractures in a horizontal well", Presented at the SPE Hydraulic Fracturing Technology Conference, 4-6 February, Woodlands, Tex., USA. SPE-163848-MS. In the two cases, longitudinal fractures of two drastically different axial extents were considered: contained within the single perforation cluster ($\alpha$=0.125) or the span in between them ($\alpha$=0.005), which was characterized by the dimensionless parameter a equal to the ratio of axial extent of longitudinal fracture and wellbore radius. It can be seen in those scenarios that injection pressures exhibit growth following initiation of fractures. Decrease of the axial extent of longitudinal fracture and injection line compressibility resulted in higher breakdown pressure. Despite a transverse fracture requiring less pressure to initiate, over the growth of the fracture the wellbore pressure exceeded the longitudinal fracture initiation pressure. This means that even though configuration of the wellbore and notch implies lower initiation pressure for transverse fracture, the wellbore may still be broken longitudinally during the "pressure rollover" phase of transverse fracture growth.

As mentioned above, an initiated longitudinal fracture may introduce undesirable fracture complexity as well as propagation beyond the packer, which could disturb the isolation between stages. Embodiments of the present disclosure include methods of how this can be avoided in the field.

Apart from the above addressed issues of initiating the single fracture, initiation and growth of multiple fractures is also included in embodiments of the present disclosure. According to some embodiments, an adaptation of known technique referred to as "the limited entry technique" can be used to make several fractures grow from multiple perforation clusters. According to some further embodiments, especially in cases of larger numbers of perforation clusters per stage and/or variations of conditions for fracture initiation at each cluster—a diversion technique can be applied to maximize the number of initiated clusters. See U.S. Pat. No. 2,970,645 to Glass in 1961 (referred to herein as "the '645 patent" and incorporated by reference). First, the fracture is initiated at one position in the stimulated section of the wellbore. After the fracture has grown to the desired dimensions, the fracturing fluid is switched to one containing special agents that mechanically plug the created fracture so as the injection continues and a new fracture can initiate at a different location. This switching between fracturing fluid and diverter is repeated until the desired number of fractures has been initiated. As a diverter pill, one can use fluid mixed with fibers, poly-dispersed particles or even proppant can be used in some cases. According to some embodiments, the diversion material should be configured to degrade away, or such that it can be produced back out of the well when production is started. For further details of diversion techniques as part of a proposed workflow for multiple fracture initiation from open holes including the ones containing weak points, see co-owned, U.S. Pat. No. 7,644,761, entitled "Fracturing Method for Subterranean Reservoirs", the contents of which are incorporated herein by reference. Placing weak points in the form of circular notches in the vertical openhole section to initiate multiple fractures and from there using diversion is discussed in the '645 patent. Various options for diverter fluid can also be found in U.S. Pat. No. 5,238,067, the contents of which are incorporated herein by reference, where diversion was proposed as a way to increase the fracture network by initiating additional fractures.

During the multistage fracturing treatments of the wells, hydraulic fractures are conventionally created by injecting the fracturing fluid into the well at a fixed (designed) rate, usually close to the maximum rate that can be achieved with the surface plant to minimize job time. During the well treatment the fracturing fluid may be switched between the pad (or proppant slurry) and diverter to initiate hydraulic fractures in other locations within the stimulated stage. Those locations may be defined by perforation clusters or notches cut into the wellbore wall (through the casing in case of cemented-and-cased completion).

As shown above, by example of notched open hole, the conventional practice of injecting the fluid at a constant rate may result in a hydraulic fracture initiated longitudinally even while pressure is reaching its peak region following the initiation of a transverse fracture.

Embodiments of the subject disclosure relate to performing injection in a fracturing job by controlling the target pressure within the stimulated stage rather than minimizing operational time on-site by using a prescribed injection rate. This can be achieved by either using the downhole pressure gauge(s) during the job, or correcting the surface pressure measurements by the estimated friction losses. Where possible from the completion design and where it can be isolated from the proppant slurry (or, for example in an Acid-fracturing operation), utilization of a downhole gauge is a preferred method, and may enable additional control of the fracture geometry by feed-back in real time to the surface pumps, by understanding the pressure characteristics of the different fracture geometries in the respective target intervals. Procedures involving injection at the constant bottomhole pressure are described herein. An example of a notch in an openhole wellbore is used, however the described processes can be easily applied onto other weak point and wellbore completion types: e.g., a perforation cluster within the cemented and cased wellbore.

Figure 4:
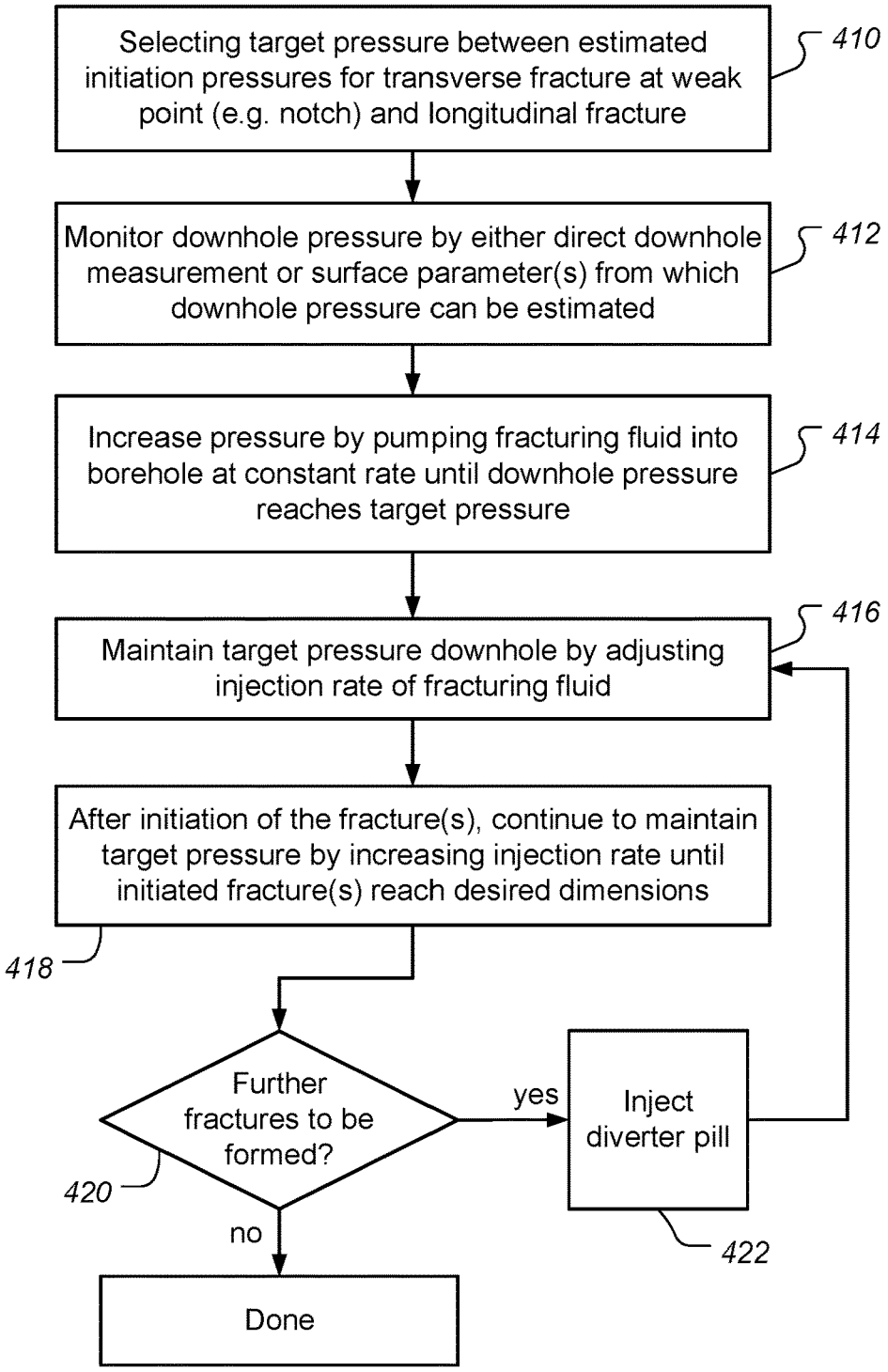
FIG. 4 is a diagram illustrating aspects of creating hydraulic fractures in oil and gas wells, according to some embodiments.

FIG. 4 is a diagram illustrating aspects of creating hydraulic fractures in oil and gas wells, according to some embodiments. In block 410, the method comprises first setting up a target pressure between the estimated initiation pressures for the transverse fracture at the notch and a longitudinal fracture. The dimensions of the notch, required for this estimation, could be determined using acoustic, neutron or resistivity logging tools. In block 412, the downhole pressure is monitored by either direct downhole measurement or surface parameter(s) from which downhole pressure can be estimated. By keeping the pressure within the stage always below or equal to the target pressure, the risk of longitudinal fracture initiation is substantially reduced or minimized.

In block 414, the pressure is increase by pumping fracturing fluid into a borehole at a constant rate until downhole pressure reaches target pressure. If a transverse fracture has not been initiated during the pressure building up to a target level, the pressure is then maintained at the target level until the fracture initiates at the notch. Maintaining the pressure at the target fracture will benefit from the static fatigue mechanisms in rock failure and initiate the hydraulic fracture at the notch at a lower pressure but delayed in time. See Lu, G., Uwaifo, E. C., Ames, B. C., et al. 2015. Experimental Demonstration of Delayed Initiation of Hydraulic Fractures below Breakdown Pressure in Granite. Presented at the 49th US Rock Mechanics/Geomechanics Symposium, San Francisco, Calif., USA, 28 June-1 July. ARMA 15-190. Also, maintaining the target pressure downhole also requires a lower injection rate, which will switch the fracture initiation process into a "slow pressurization" mode. The latter is also known for lowering the fracture initiation pressure compared to the "fast pressurization" case in a conventional fracturing job. See Detournay, E., Carbonell, R. 1997. Fracture-Mechanics Analysis of the Breakdown Process in Minifracture or Leakoff Test. SPE Prod & Fac 12 (3): 195-199, SPE-28076-PA.

Figure 5:
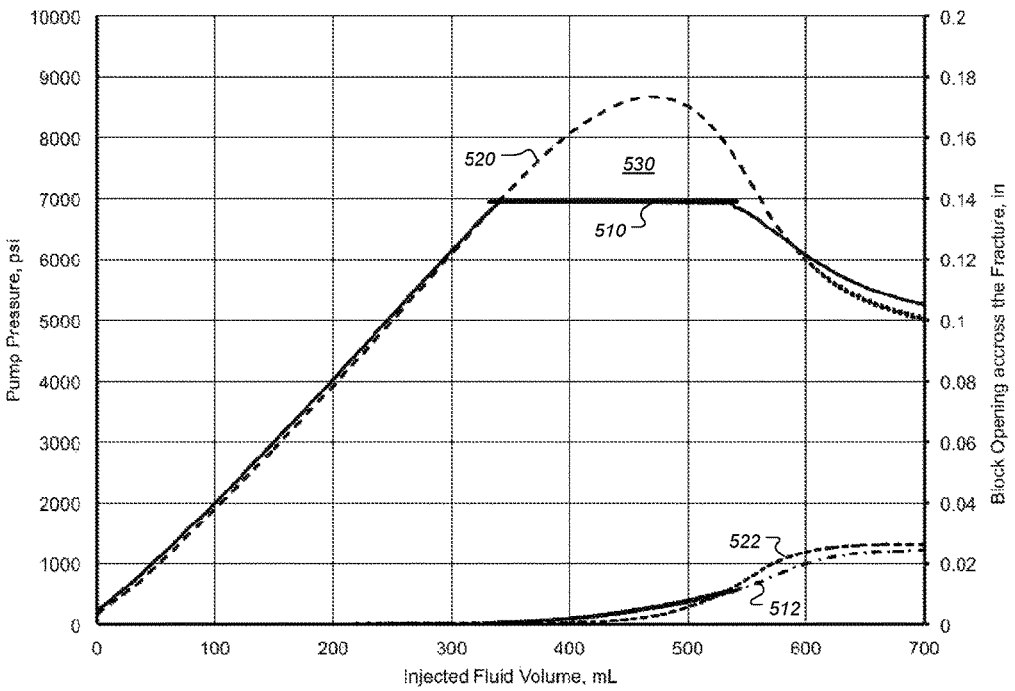
FIG. 5 is a plot comparing two hydraulic fracturing block tests where transverse fractures of similar dimensions were created.

Maintaining the pressure inside the stimulated interval at the target level can be accomplished by injecting at minor rates to compensate for the fracturing fluid leakoff into the formation only. Beyond this point and until initiation of the fracture, no extra horse-power is spent in elevating the pressure further (which will not disappear, but is stored in the wellbore as stored energy), reducing plant requirements, one of the key cost drivers in fracturing, as well as minimizing fluid loss and waste. The fracturing treatment performed using the proposed fixed pressure approach reduces the total energy spent in creating the fracture network. FIG. 5 is a plot comparing two hydraulic fracturing block tests where transverse fractures of similar dimensions were created. The curve 520 shows pressure measured at the pump vs. injected fluid volume for a test using constant injection rate, while curve 510 shows pump pressure vs. injected fluid volume for a test where a constant pressure was maintained. In both tests notches were practically the same (1.2 WBD in depth). Block displacement across the fracture (which is related to fracture opening) were also measured and are plotted as functions of the injected fluid volume in curve 522 for the constant injection rate case and in curve 512 for the constant pressure case (both using the right side vertical axis). The region 530 between pressure curves 520 and 510 represents extra mechanical work spent on initiation of fracture of similar dimensions when a constant injection rate technique is applied when compared to the constant pressure technique.

Referring again to FIG. 4, in block 416, once the pressure is brought to the target value, it is then kept at that level until hydraulic fracture(s) initiates or the decision is made to change the target pressure value. Maintaining the pressure inside the stimulated interval at the target level would require injection at minor rates to compensate for the fracturing fluid leakoff into the formation only. In block 418, after the fracture(s) initiates, the injection rate is increased to keep up with the target pressure as the fracture(s) starts to grow and take more fluid. During the constant pressure phase the point of initiation of the fracture(s) is manifested by the beginning of an increase in injection rate, which is generally easier to spot in a plot of injection rate vs time compared to the conventional constant injection rate approach.

Additionally, the phase of maintaining a constant pressure that precedes the fracture initiation provides a natural measurement of the effective leakoff rate into the formation to allow better job calibration.

Following the initiation of fracture(s), the injection rate is increased until it reaches the maximum (prescribed) value. During this period, the initiated fracture(s) is propagated and propped as in a usual hydraulic fracturing job. At some point, e.g., when the initiated fractures reach the designed dimensions, the diverter pill is injected in block 422 provided further fractures are to be formed (block 420). The diverter pill is designed to plug the newly created fractures. The moment of fracture diversion (plugging) will be manifested by a rapid decrease in injection rate, under the condition of the fracture growth pressure being kept under the target limit value.

The workflow is then repeated to initiate and grow the hydraulic fractures from other weak points found throughout the wellbore. Multiple weak point designs may be employed which ensures fractures grow from only designated locations, controlled by the pressure.

Figure 6:
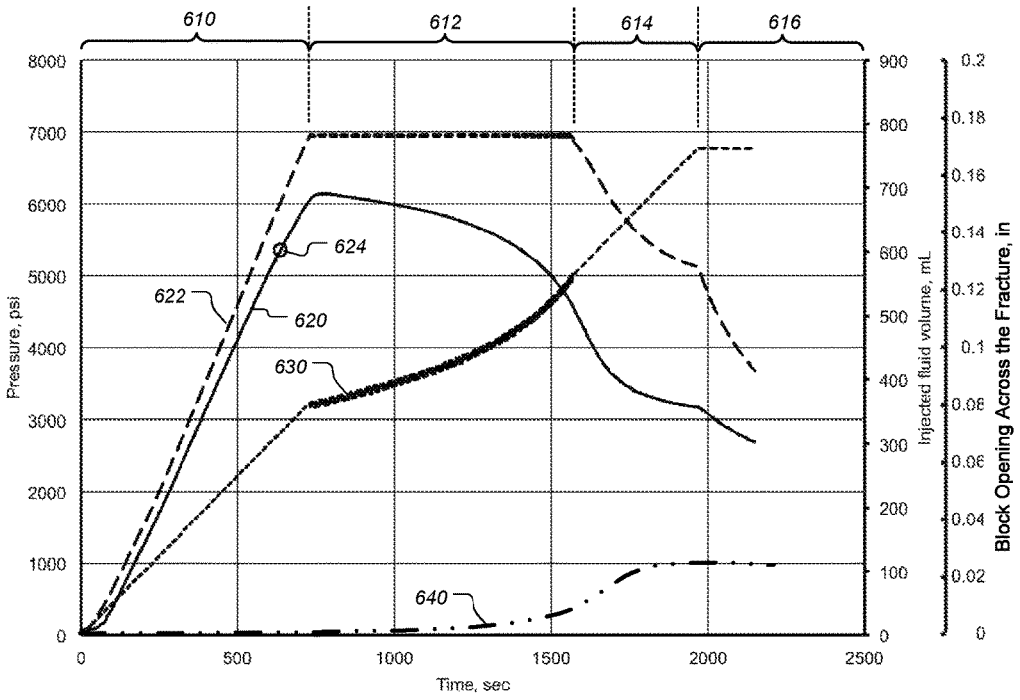
FIG. 6 is a plot showing results of a hydraulic fracturing block test performed using constant pressure techniques, according to some embodiments.

FIG. 6 shows an example of the constant pressure technique implemented in a hydraulic fracturing block test, according to some embodiments. When designing the test, initiation pressures for longitudinal (without a notch) and transverse (for various notch depths) fractures were taken from the experimental results shown in FIG. 3. In field practice, according to some embodiments, the initiation pressures for the open hole with and without a notch will be known either from laboratory studies combined with previous jobs or from theoretical estimates. During the test the injection pressure was controlled up-stream from the injection line—at a high pressure pump. Curves 620 and 622 show the borehole pressure and the pump pressure recorded during the test, respectively. Curve 630 shows the injected fluid volume (using the right side primary axis) and curve 640 shows the block deformation or opening across the induced fracture (using the right side secondary axis). The fracture initiation point is shown by the circle 624. First, during phase 610, viscous fracturing fluid was injected into the borehole with a notched openhole section at the constant rate of 0.5 mL/sec until the pump pressure reached the target value of 6,950 psi. This value was chosen above the initiation pressures for the range of possible notch depths (5,200-5,900 psi), but was still below the initiation pressure for longitudinal fractures (7,900 psi). Initiation of hydraulic fracture happened to occur over the constant rate injection phase 610 and was manifested by deviation of the borehole pressure curve 620 from the straight line around 5,350 psi (circle 624). As expected, borehole pressure continued to grow by almost 800 psi until injection was switched to constant pressure mode once the pump pressure target has been reached. By that moment, transverse fracturing was initiated at the notch while further pressure increase had been prevented, thereby eliminating the risk for longitudinal fracture initiation. As a result, the injection rate was dropped immediately to 0.1 mL/sec. During the following phase 612 the injection rate was controlled automatically to maintain this pressure target. Although the injection rate was dropped to 0.1 mL/sec, at this point the fracture was already growing and able to take more fluid. The injection rate gradually increased to 0.7 mL/sec over phase 612 until the controls were switched back to a constant injection rate of 0.5 mL/sec which was continued during phase 614. Pressure continued decreasing as fracture went out of the block. In the final phase 616, the fluid injection was ceased and the fracture was allowed to begin closing. Post-test evaluation of the block sample confirmed one transverse fracture was initiated from the notch with no longitudinal fractures present.

Figure 7:
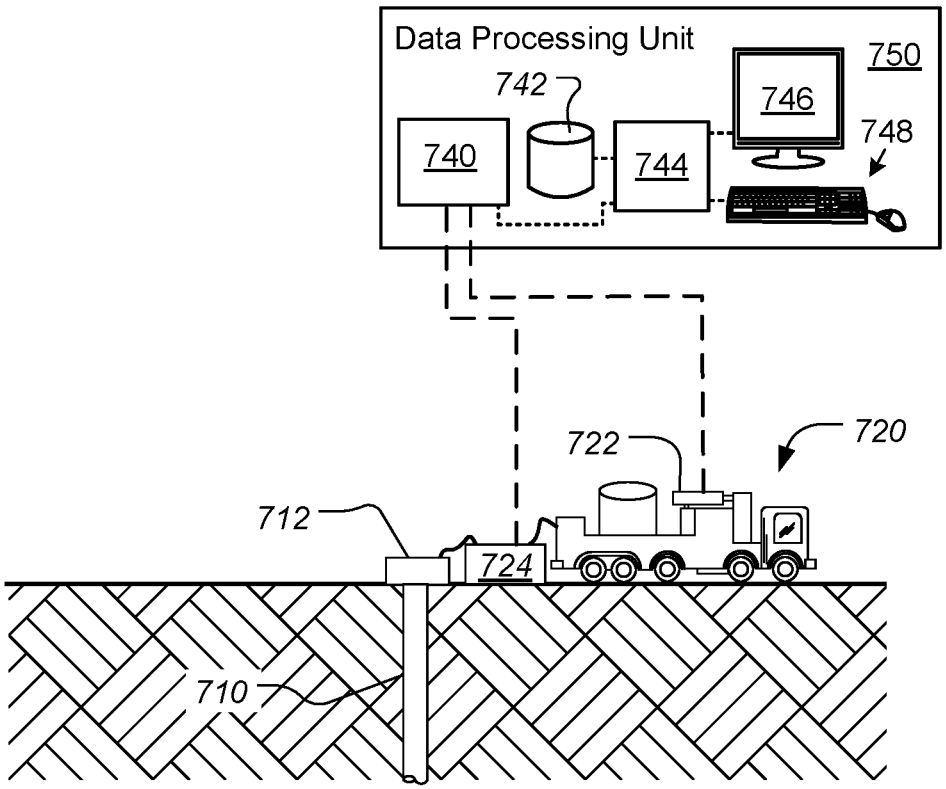
FIG. 7 is a diagram illustrating a system for hydraulic fracturing by initiating one or more transverse hydraulic fractures, according to some embodiments.
Figure 7:
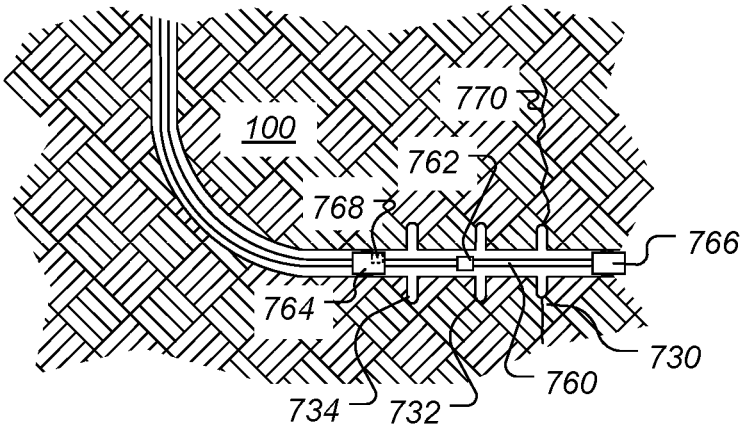

FIG. 7 is a diagram illustrating a system for hydraulic fracturing by initiating one or more transverse hydraulic fractures, according to some embodiments. The fracturing is desired in subterranean hydrocarbon-bearing formation 100. A hydraulic fracturing tool 760 is deployed via a coiled tubing truck (not shown) into wellbore 710 that extends from the well head 712 on the surface to the formation 100 that is to be fractured. According to some embodiments, wellbore 710 is drilled in the direction of minimal stress within formation 100 in the region to be fractured. The fracturing tool 760 is hydraulically attached to pumping truck 720. Equipment at the wellsite can also includes one or more other service vehicles such as mixing equipment and/or other pumping equipment (not shown). Data processing unit 750, which according to some embodiments, includes a central processing system 744, a storage system 742, communications and input/output modules 740, a user display 746 and a user input system 748. The data processing unit 750 may be located in or on pumping truck 720, and/or may be located in other facilities at the wellsite or in some remote location. According to some embodiments, processing unit 750 is used to monitor and control at least some aspects of pumping equipment on truck 720 and hydraulic fracturing tool 760. Further examples of tools and/or systems that may be used in hydraulic fracturing are provided in U.S. Pat. No. 7,828,063 and U.S. Pat. Appl. Publ. No. US2104/0069653, both of which are incorporated herein by reference. Tool 760 includes a nozzle module 762 and upper and lower packers 764 and 766 that isolate fracturing fluid being pumped though the nozzle module 762 to the region between the two packers. According to some embodiments, a pressure measurement device 768 is included to directly monitor the downhole fluid pressure. In this example, multiple notches 730, 732 and 734 are formed in the region being fractured. The notches are predefined weak points and can be in the form of perforation clusters or notches. According to some embodiments, examples of notches include "circular perforations" such as shown in FIG. 2. In some examples, the notches are made using techniques such as: mechanical scribing, high pressure jetting, laser tools, and/or specific arrangements of shaped charges. According to some embodiments, the transverse fracture initiation technique such as described in FIG. 4 and elsewhere herein is carried out by the equipment shown in FIG. 7. Shown in FIG. 7 is a transverse fracture 770 that has been initiated from notch 730. Although in the example shown in FIG. 7 the borehole is openhole in the region being fractured, the techniques described herein can also be applied to cemented and cased boreholes, according to some embodiments.

According to some embodiments, one or more surface measurements can be made which are indicative of the downhole pressure. Such measurements may be useful, for example, in cases when direct downhole pressure measurement is unavailable. In some cases, surface pressure and fluid injection rate are coupled with a mechanical wellbore and fluid interaction model to constrain uncertainty in the downhole pressure. Alternatively one may deploy a permanent fiber optic cable along the length of the well that contains no pressure gauge assembly and therefore is resistant to proppant slurry, or the cable may be deployed behind casing, and is substantially sensitive to acoustic waves (DAS/DVS). With collapsible elements incorporated into the fluid which generate a significant acoustic signature when they collapse under a predetermined pressure, the location of the collapse can be detected by the fiber optics, and therefore indirectly measuring the local pressure.

Thus, according to some embodiments, methods for multistage stimulation fracturing treatment of oil & gas horizontal wellbores are described. The method comprises creating one or more transverse hydraulic fractures at notches or predefined weak points along the wellbore drilled in the direction of minimal stress. The method further comprises performing a fracturing job by bringing the pressure within the stimulated section to the designed level, and maintaining it at that level by adjusting the injection rate. The target bottomhole pressure level is chosen to be above the initiation pressure for transverse fractures at the notches or predefined weak points, but below the initiation pressure for longitudinal fractures. The described techniques can lower the risk of longitudinal fracture initiation.

Methods disclosed in the subject disclosure benefit from lower breakdown pressure due to static fatigue effects or pore pressure influence in "low pressurization limit". Furthermore, methods disclosed in the subject disclosure can reduce the horse-power requirements for the operation or reduce the total energy spent in creating the fracture network.

Methods of the subject disclosure can be used to determine the moment of fracture initiation manifested by the beginning of increase of injection rate vs time, which can be easier than compared to the conventional constant pumping rate approach.

Methods of the subject disclosure can benefit a measurement of the effective leakoff rate into the formation to allow improved job calibration.

Methods of the subject disclosure can be used in combination with a diversion technique to maximize the number of weak points within the stimulated stage/wellbore section that initiated transverse fractures.

Some of the methods and processes described above, including processes, as listed above, can be performed by a processor or processing system such as system 750 shown in FIG. 7. The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above. The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method of creating transverse hydraulic fractures in an earth formation surrounding a wellbore, the method comprising:

selecting a target downhole pressure level that is greater than an initiation pressure for a transverse fracture in the earth formation and less than an initiation pressure for a longitudinal fracture in the earth formation;

injecting a fracturing fluid into the wellbore;

monitoring at least one parameter related to downhole pressure; and controlling the fluid injection based on the monitored parameter in order to maintain a downhole pressure that is within a predetermined range of the selected target downhole pressure, to facilitate initiation of one or more transverse fractures without initiation of longitudinal fractures in the earth formation.

2. The method according to claim 1, further comprising:

forming one or more weak points along the wellbore configured to facilitate initiation of the one or more transverse fractures therefrom.

3. The method according to claim 2, wherein the wellbore is open hole where the one or more transverse fractures are initiated, and the one or more weak points are perforations or notches and are formed using one or more techniques selected from a group consisting of: mechanical scribing, high pressure jetting, cutting with laser tools, and arranging of shaped charges.

4. The method according to claim 2, wherein the wellbore includes a casing where the one or more transverse fractures are initiated and the weak points are in the form of one or more perforations in the casing.

5. The method according to claim 1, wherein the at least one monitored parameter is pressure measured using a downhole pressure sensor.

6. The method according to claim 5, wherein said controlling the fluid injection comprises controlling one or more surface pumps and the measurements from the downhole pressure sensor provide real time feedback to effect closed-loop control of said surface pumps.

7. The method according to claim 6, wherein said closed loop control is further based in part on pre-job analysis of fracture initiation, fracture opening and fracture orientation with respect to the near wellbore and far-field stresses.

8. The method according to claim 1, further comprising:

identifying fracture initiation based at least in part on detecting an increase in fluid injection rate.

9. The method according to claim 1, wherein the initiation pressures for transverse and longitudinal fractures are known from one or more selected from a group consisting of: laboratory studies; information from previous jobs; and theoretical estimates.

10. The method according to claim 1, wherein the at least one monitored parameter is a surface measurement indicative of downhole pressure.

11. The method according to 10, wherein said surface measurement is a surface pressure measurement that is related to downhole pressure at least in part by estimating frictional losses.

12. The method according to claim 1, wherein the at least one parameter is acoustic signals measured using a fiber optic cable and the injected fluid comprises collapsible elements configured to generate an acoustic signature when they collapse under a predetermined pressure.

13. The method according to claim 1, wherein multiple transverse fractures are sequentially initiated.

14. The method according to claim 13, further comprising:

injecting a composition configured to temporarily plug one or more fractures such that further transverse fractures may be initiated.

15. The method according to claim 1 further comprising:

in a first phase, injecting the fracturing fluid into the wellbore at a constant flow rate; and after the downhole pressure is within the predetermined range of the target downhole pressure, in a second phase, injecting the fracturing fluid into the wellbore so as to maintain the downhole pressure within the predetermined range of the target downhole pressure.

16. The method according to claim 15, wherein at least one of the one or more transverse fractures is initiated during the first phase.

17. The method according to claim 1, wherein the wellbore where the one or more transverse fractures are initiated is horizontal or nearly horizontal and is formed along a minimal horizontal far-field stress of the earth formation.

* * * * *